US008118626B2

(12) United States Patent
Kuriyagawa et al.

(10) Patent No.: US 8,118,626 B2
(45) Date of Patent: Feb. 21, 2012

(54) OUTBOARD MOTOR CONTROL APPARATUS

(75) Inventors: Koji Kuriyagawa, Saitama (JP); Hajime Yoshimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 136 days.

(21) Appl. No.: 12/760,238

(22) Filed: Apr. 14, 2010

(65) Prior Publication Data

US 2010/0267293 A1 Oct. 21, 2010

(30) Foreign Application Priority Data

Apr. 17, 2009 (JP) ..... 2009-101154

(51) Int. Cl.
*B63H 21/21* (2006.01)

(52) U.S. Cl. ..... 440/1; 701/67

(58) Field of Classification Search ... 440/1; 123/559.1, 123/559.3, 561, 564; 701/67
See application file for complete search history.

(56) References Cited

U.S. PATENT DOCUMENTS 5,307,783 A * 5/1994 Satoya et al. ..... 123/559.3
6,378,506 B1 * 4/2002 Suhre et al. ..... 123/564

FOREIGN PATENT DOCUMENTS

JP 2007-315498 A 12/2007

* cited by examiner

*Primary Examiner* — Lars A Olson
(74) *Attorney, Agent, or Firm* — Carrier Blackman & Associates, P.C.; Joseph P. Carrier; William D. Blackman

(57) ABSTRACT

In an apparatus for controlling operation of an outboard motor mounted on a boat and having a torque converter equipped with a lockup clutch, it is configured to calculate a speed ratio of the torque converter based on an input rotation speed and output rotation speed of the torque converter, detect manifold absolute pressure of the engine, control the lockup clutch to ON when the calculated speed ratio has been equal to or greater than a reference value, and control the lockup clutch to OFF when the manifold absolute pressure has been decreased by a first predetermined value or more. With this, it becomes possible to prevent the boat speed from decreasing even when the resistance of water flow acting on the boat increases due to the influence of a wave etc., thereby maintaining the maximum speed.

14 Claims, 6 Drawing Sheets

OUTBOARD MOTOR CONTROL APPARATUS

BACKGROUND OF THE INVENTION

1. Field of the Invention

This invention relates to an outboard motor control apparatus, particularly to an apparatus for controlling an outboard motor having a torque converter.

2. Description of the Related Art

In recent years, there is proposed an outboard motor having a torque converter interposed between an internal combustion engine and drive shaft to amplify output torque of the engine and then transmit it to the drive shaft for enhancing acceleration performance, etc., as taught, for example, by Japanese Laid-Open Patent Application No. 2007-315498 ('498). In this conventional technique, the torque converter includes a lockup clutch.

SUMMARY OF THE INVENTION

The outboard motor having the torque converter as in the reference is configured so that the lockup clutch is made ON (engaged) upon completion of the acceleration to prevent loss in transmittance of the engine output caused by slippage of the torque converter, thereby making the boat speed reach the maximum speed.

In the case where a boat equipped with such the outboard motor climbs up and goes over a relatively big wave with the lockup clutch positioned ON, the wave influences the resistance of water flow acting on the boat to increase. It results in the insufficiency of the output torque of the engine, whereby the boat speed may decrease. It is disadvantageous that the maximum speed can not be maintained.

An object of this invention is therefore to overcome the foregoing drawback by providing an apparatus for controlling an outboard motor having a torque converter, which apparatus can prevent the boat speed from decreasing even when the resistance of water flow acting on the boat increases due to the influence of a wave or the like, thereby maintaining the maximum speed.

In order to achieve the object, this invention provides in its first aspect an apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising: a speed ratio calculator that calculates a speed ratio of the torque converter based on an input rotation speed and output rotation speed of the torque converter; a manifold absolute pressure detector that detects manifold absolute pressure of the engine; and a clutch controller that controls the lockup clutch to ON when the calculated speed ratio has been equal to or greater than a reference value, and controls the lockup clutch to OFF when the detected manifold absolute pressure has been decreased by a first predetermined value or more.

In order to achieve the object, this invention provides in its second aspect a method of controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising steps of: calculating a speed ratio of the torque converter based on an input rotation speed and output rotation speed of the torque converter; detecting manifold absolute pressure of the engine; and controlling the lockup clutch to ON when the calculated speed ratio has been equal to or greater than a reference value, and controlling the lockup clutch to OFF when the detected manifold absolute pressure has been decreased by a first predetermined value or more.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

A preferred embodiment of an outboard motor control apparatus according to the invention will now be explained with reference to the attached drawings.

Figure 1:
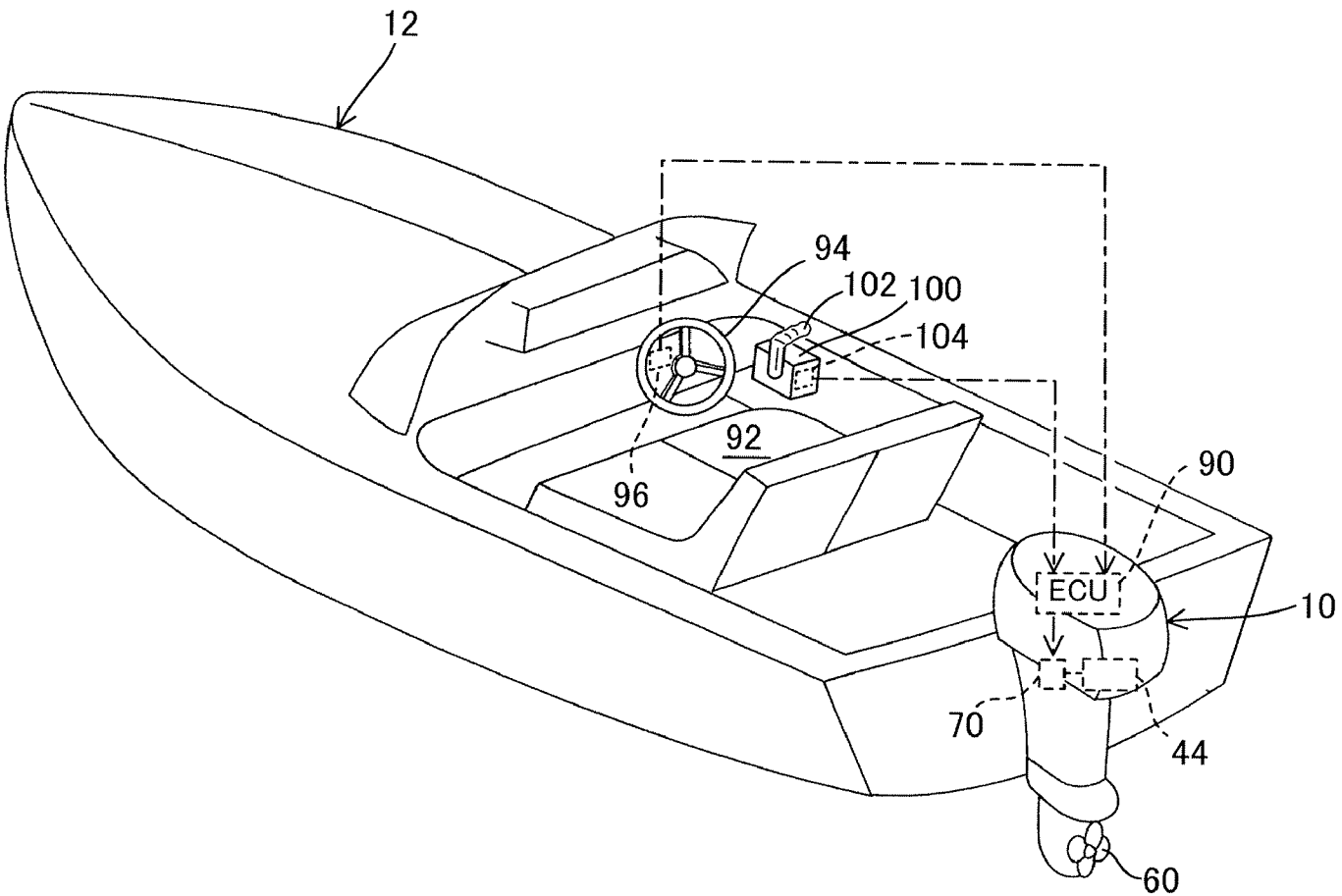
FIG. 1 is an overall schematic view of an outboard motor control apparatus including a boat (hull) according to an embodiment of the invention.
Figure 2:
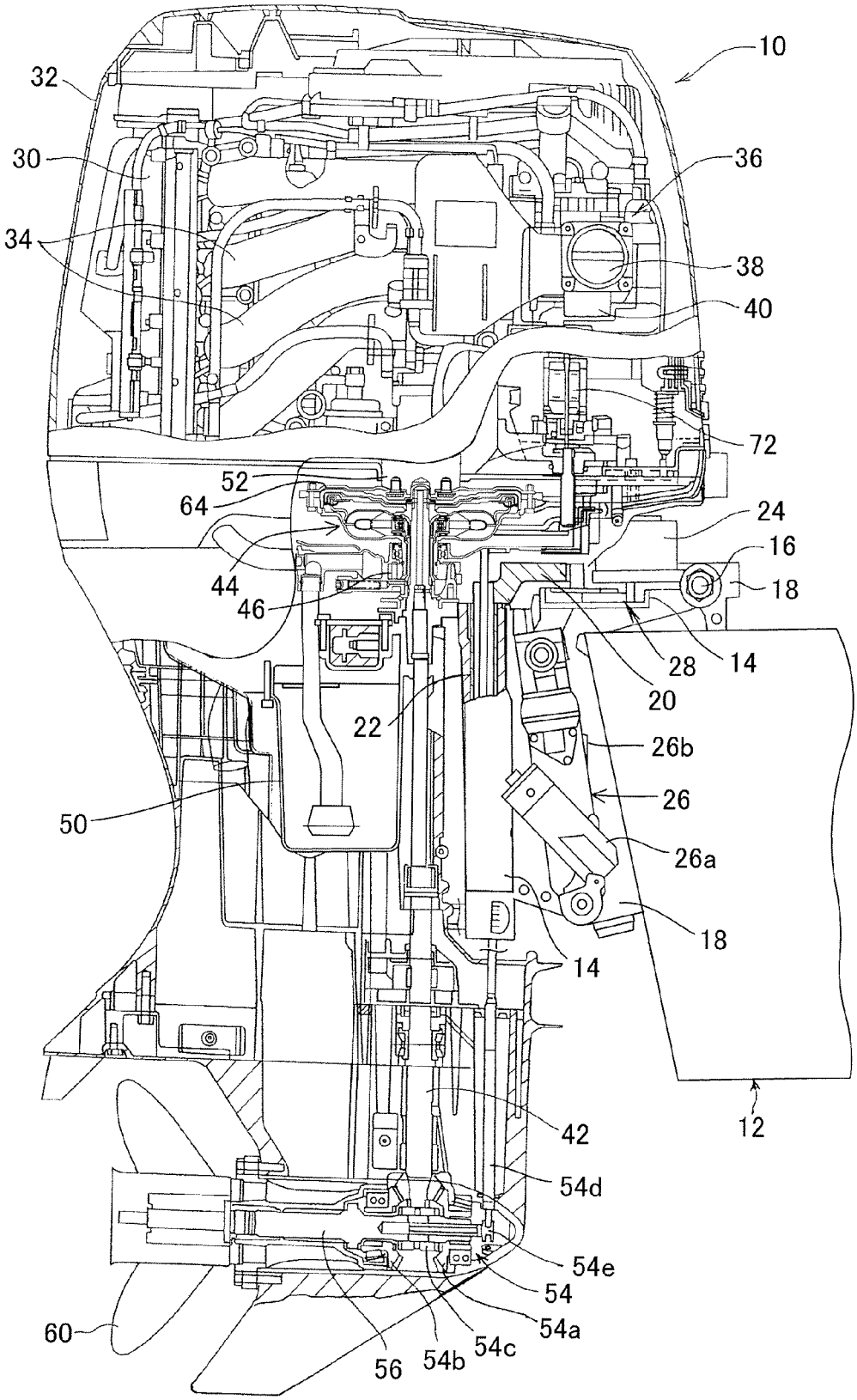
FIG. 2 is an enlarged sectional side view partially showing the outboard motor shown in FIG. 1.

FIG. 1 is an overall schematic view of an outboard motor control apparatus including a boat (hull) according to an embodiment of the invention. FIG. 2 is an enlarged sectional side view partially showing the outboard motor shown in FIG. 1 and FIG. 3 is an enlarged side view of the outboard motor.

Figure 3:
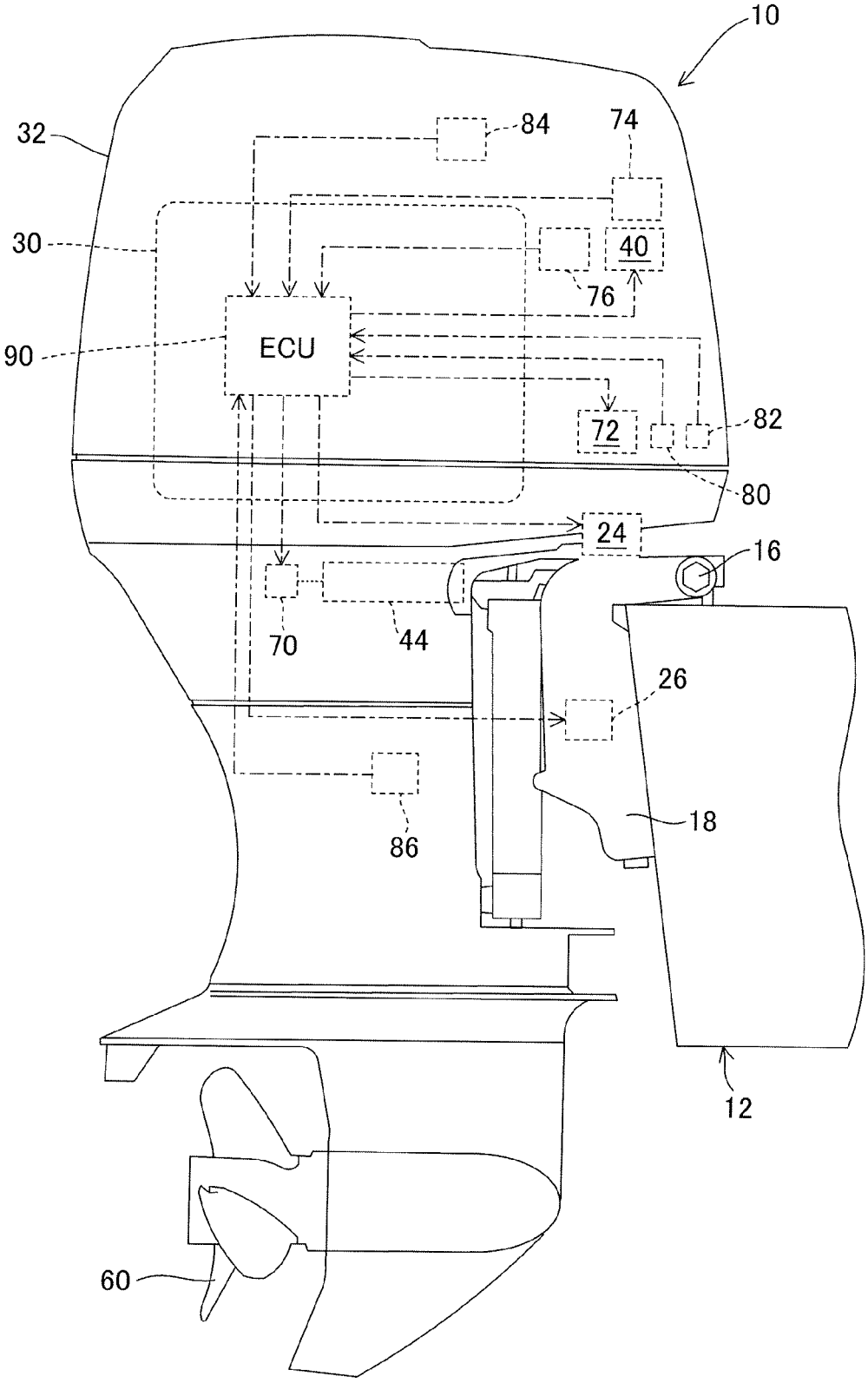
FIG. 3 is an enlarged side view of the outboard motor shown in FIG. 1.

In FIGS. 1 to 3, a symbol 10 indicates an outboard motor. As illustrated, the outboard motor 10 is clamped (fastened) to the stern or transom of a boat (hull) 12.

As shown in FIG. 2, the outboard motor 10 is fastened to the boat 12 through a swivel case 14, tilting shaft 16 and stern brackets 18. The outboard motor 10 is equipped with a mount frame 20 and shaft 22. The shaft 22 is housed in the swivel case 14 to be rotatable about the vertical axis such that the outboard motor 10 can be rotated about the vertical axis relative to the boat 12. The mount frame 20 is fixed at its upper end and lower end to a frame (not shown) constituting a main body of the outboard motor 10.

An electric steering motor (actuator) 24 for operating the shaft 22 and a power tilt-trim unit 26 for regulating a tilt angle and trim angle of the outboard motor 10 are installed near the swivel case 14. A rotational output of the steering motor 24 is transmitted to the shaft 22 via a speed reduction gear mechanism 28 and the mount frame 20, whereby the outboard motor 10 is steered about the shaft 22 as a steering axis to the right and left directions (steered about the vertical axis).

The power tilt-trim unit 26 integrally comprises a hydraulic cylinder 26*a* for adjusting the tilt angle and a hydraulic cylinder 26*b* for adjusting the trim angle. When the hydraulic cylinders 26*a*, 26*b* are extended and contracted, the swivel case 14 is rotated about the tilting shaft 16 as a rotational axis, thereby tiling up/down and trimming up/down the outboard motor 10.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control the engine speed.

The outboard motor 10 further comprises a drive shaft (vertical shaft) 42 installed parallel to the vertical axis to be rotatably supported, a torque converter 44 interposed between the engine 30 and drive shaft 42, a hydraulic pump 46 that is attached to the drive shaft 42 and pumps operating oil to a lubricated portion of the engine 30, the torque converter 44 and the like, and a reservoir 50 for reserving the operating oil.

The upper end of the drive shaft 42 is connected to a crankshaft 52 of the engine 30 through the torque converter 44 and the lower end thereof is connected via a shift mechanism 54 with a propeller shaft 56 supported to be rotatable about the horizontal axis. One end of the propeller shaft 56 is attached with a propeller 60. Thus the drive shaft 42 connects the engine 30 with the propeller 60.

Figure 4:
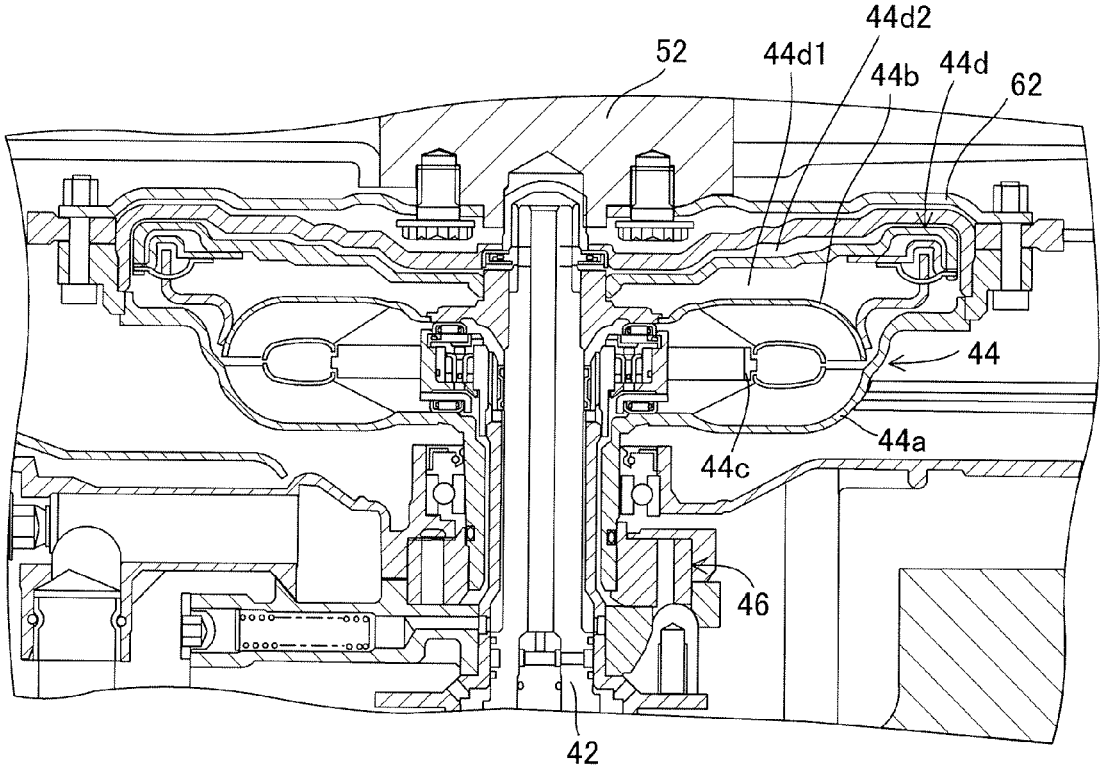
FIG. 4 is an enlarged sectional view showing a region around a torque converter shown in FIG. 2.

FIG. 4 is an enlarged sectional view showing a region around the torque converter 44 shown in FIG. 2.

As shown in FIG. 4, the torque converter 44 includes a pump impeller 44*a* connected to the crankshaft 52 through a drive plate 62, a turbine runner 44*b* that is installed to face the pump impeller 44*a* to receive/discharge the operating oil and connected to the drive shaft 42, a stator 44*c* installed between the pump impeller 44*a* and turbine runner 44*b*, a lockup clutch 44*d* and other components.

Figure 5:
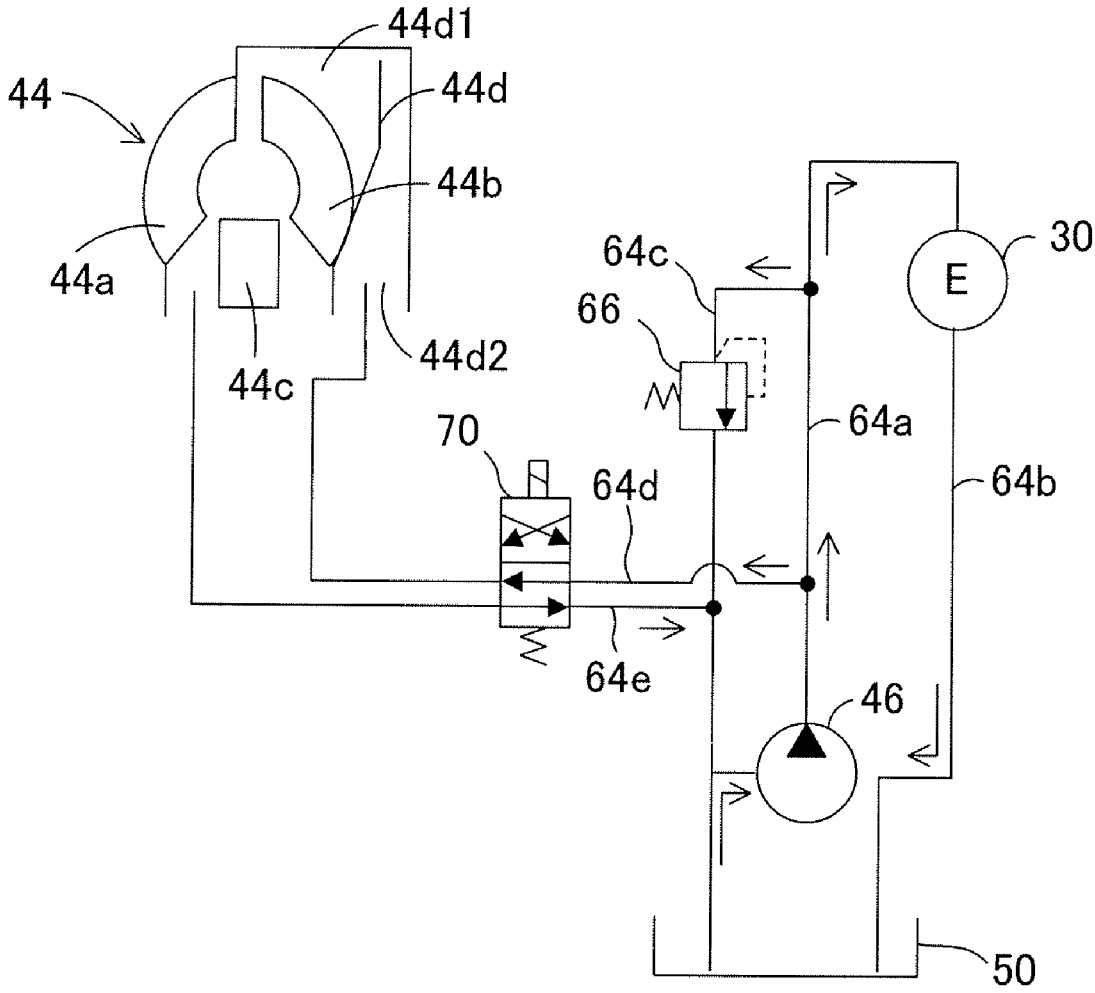
FIG. 5 is a hydraulic circuit diagram schematically showing the torque converter, a hydraulic pump and other components shown in FIG. 2.

FIG. 5 is a hydraulic circuit diagram schematically showing the torque converter 44, hydraulic pump 46, etc.

The hydraulic pump 46 driven by the engine 30 pumps up the operating oil in the reservoir 50 and forwards it to a first oil passage 64*a*. The pressurized operating oil forwarded to the first oil passage 64*a* is supplied to the lubricated portion of the engine 30 or the like and then returns to the reservoir 50 through a second oil passage 64*b*.

The first oil passage 64*a* is provided with a third oil passage 64*c* connecting the first oil passage 64*a* with an intake hole of the hydraulic pump 46. The third oil passage 64*c* is interposed with a relief valve 66 that opens when the pressure of the operating oil to be supplied to the engine 30 is at or above a defined value and closes when it is below the defined value.

A fourth oil passage 64*d* for circulating the operating oil to be supplied to the torque converter 44 is connected to the first oil passage 64*a* at a point between a discharge hole of the hydraulic pump 46 and a branch point of the first and third oil passages 64*a*, 64*c*. A fifth oil passage 64*e* for circulating the operating oil returning from the torque converter 44 to the hydraulic pump 46 is connected to the third oil passage 64*c* at a location downstream of the relief valve 66. The fourth and fifth oil passages 64*d*, 64*e* are installed with a lockup control valve 70 for controlling the operation of the lockup clutch 44*d*.

The lockup control valve 70 is a solenoid valve. The output of the valve 70 is connected to a piston chamber 44*d*1 of the lockup clutch 44*d* of the torque converter 44, and also connected to a chamber (rear chamber) 44*d*2 disposed in the rear of the piston chamber 44*d*1. The lockup control valve 70 switches the oil passage upon being magnetized/demagnetized, thereby controlling the ON/OFF state (engagement/release) of the lockup clutch 44*d*.

Specifically, when the lockup control valve 70 is magnetized, the operating oil is supplied to the piston chamber 44*d*1 and discharged from the rear chamber 44*d*2 so as to make the lockup clutch 44*d* ON (engaged), and when the valve 70 is demagnetized (the status in FIG. 5; initial condition), the operating oil is supplied to the rear chamber 44*d*2 and discharged from the piston chamber 44*d*1 so as to make the lockup clutch 44*d* OFF (released). Since the details of the aforementioned torque converter 44 is disclosed in '498, further explanation is omitted here.

The explanation of FIG. 2 will be resumed. The shift mechanism 54 comprises a forward bevel gear 54*a* and reverse bevel gear 54*b* which are connected to the drive shaft 42 to be rotated, a clutch 54*c* which can engage the propeller shaft 56 with either one of the forward bevel gear 54*a* and reverse bevel gear 54*b*, and other components.

The interior of the engine cover 32 is disposed with an electric shift motor (actuator) 72 that drives the shift mechanism 54. The output shaft of the shift motor 72 can be connected via a speed reduction gear mechanism (not shown) with the upper end of a shift rod 54*d* of the shift mechanism 54. When the shift motor 72 is operated, its output appropriately displaces the shift rod 54*d* and a shift slider 54*e* to move the clutch 54*c* to change the shift position among a forward position, reverse position and neutral position.

When the shift position is forward or reverse, the rotational output of the drive shaft 42 is transmitted via the shift mechanism 54 to the propeller shaft 56 to rotate the propeller 60 in one of the directions making the boat 12 move forward or rearward. The outboard motor 10 is equipped with a power source (not shown) such as a battery or the like attached to the engine 30 to supply operating power to the motors 24, 40, 72, etc.

As shown in FIG. 3, a throttle opening sensor 74 is installed near the throttle valve 38 and produces an output or signal indicative of opening of the throttle valve 38, i.e., throttle opening TH. An absolute pressure sensor (manifold absolute pressure detector) 76 is installed in the intake pipe 34 on downstream of the throttle valve 38 and produces an output or signal proportional to the manifold absolute pressure (absolute pressure) Pb.

A shift position sensor 80 installed near the shift rod 54*d* produces an output or signal corresponding to a shift position (neutral, forward or reverse) and a neutral switch 84 also installed near the shift rod 54*d* produces an ON signal when the shift position is neutral and an OFF signal when it is forward or reverse.

A crank angle sensor 84 is installed near the crankshaft 52 of the engine 30 and produces a pulse signal at every predetermined crank angle. A drive shaft rotation speed sensor 86 is installed near the drive shaft 42 and produces an output or signal indicative of rotation speed of the drive shaft 42.

The outputs of the foregoing sensors and switch are sent to an electronic control unit (ECU) 90 disposed in the outboard motor 10. The ECU 90 which has a microcomputer including a CPU, ROM, RAM and other devices is installed in the engine cover 32 of the outboard motor 10.

As shown in FIG. 1, a steering wheel 94 is installed near a cockpit (the operator's seat) 92 of the boat 12 to be manipulated or rotated by the operator. A steering angle sensor 96 installed near a shaft (not shown) of the steering wheel 94 produces an output or signal corresponding to the steering angle applied or inputted by the operator through the steering wheel 94.

A remote control box 100 provided near the cockpit 92 is equipped with a shift/throttle lever 102 installed to be manipulated by the operator. Upon the manipulation, the lever 102 can be swung in the front-back direction from the initial position and is used by the operator to input a shift position change command and engine speed regulation command. A lever position sensor 104 is installed in the remote control box 100 and produces an output or signal corresponding to a position of the lever 102. The outputs of the steering angle sensor 96 and lever position sensor 104 are also sent to the ECU 90.

Based on the inputted outputs, the ECU 90 controls the operations of the motors and ON/OFF state of the lockup clutch 44*d* of the torque converter 44.

Figure 6:
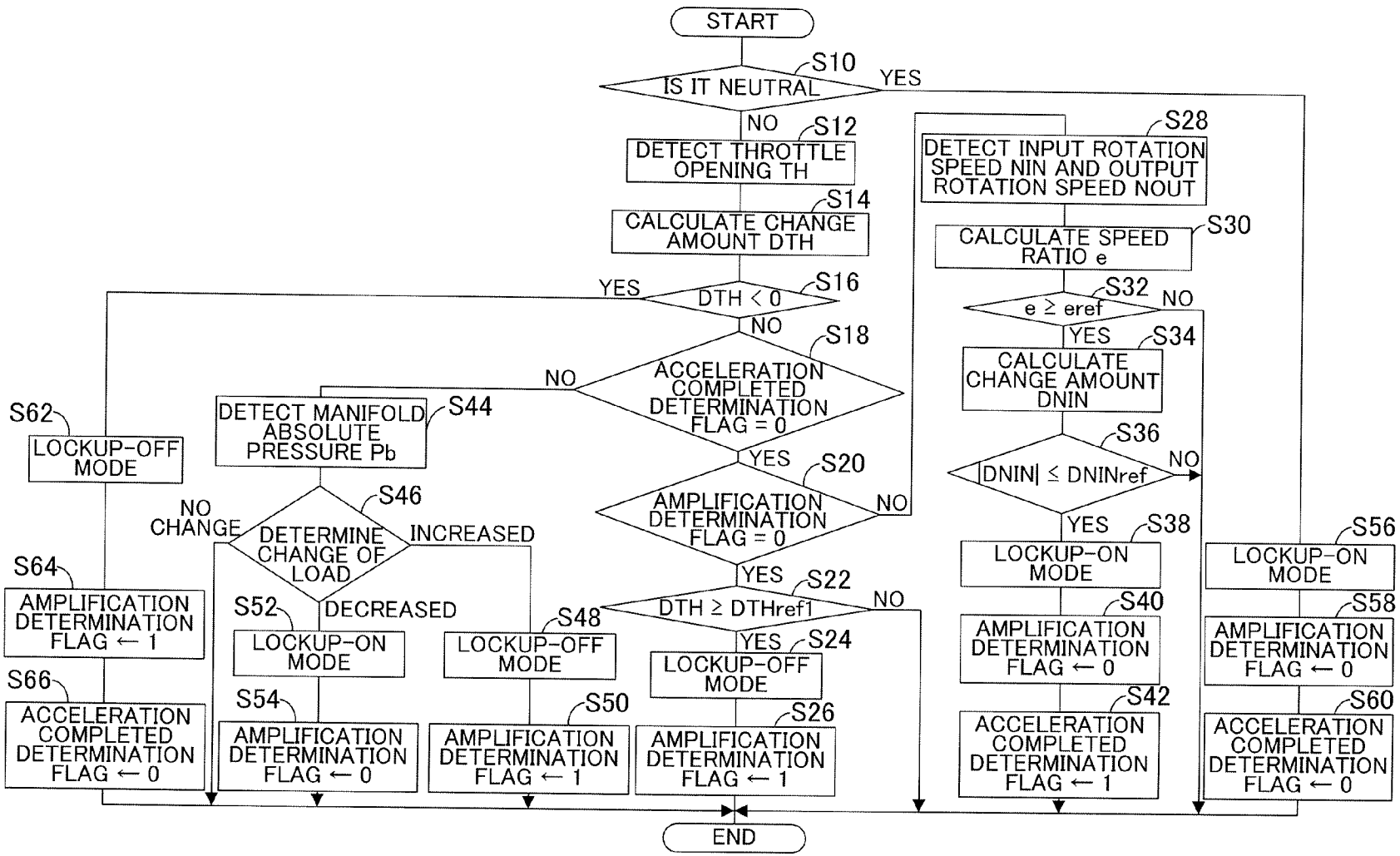
FIG. 6 is a flowchart showing the control of an electronic control unit shown in FIG. 1.

FIG. 6 is a flowchart showing the control of the ECU 90. The illustrated program is executed by the ECU 90 at predetermined interval, e.g., 100 milliseconds.

The program begins in S10, in which it is determined whether the shift position is neutral. This determination is made by checking as to whether the neutral switch 82 outputs the ON signal. When the result in S10 is negative, i.e., it is determined to be in gear, the program proceeds to S12, in which the throttle opening TH is detected or calculated from the output of the throttle opening sensor 74 and to S14, in which a change amount (variation) DTH of the detected throttle opening TH per a unit time (e.g., 500 milliseconds) is calculated.

The program proceeds to S16, in which it is determined whether the throttle valve 38 is operated in the closing direction, i.e., the boat 12 is in a condition to be decelerated (hereinafter called "decelerating condition"). This determination is made by checking as to whether the change amount DTH of the throttle opening TH is less than 0 degree. Specifically, when the change amount DTH is a negative value, the throttle valve 38 is determined to be operated in the closing direction (the boat 12 is in the decelerating condition) and when the change amount DTH is 0 or a positive value, the throttle valve 38 is determined to be operated to stop or in the opening direction (the boat 12 is operated to cruise at a constant speed or accelerate).

When the result in S16 is negative, the program proceeds to S18, in which it is determined whether a bit of an acceleration completed determination flag of the torque converter 44 (torque converter acceleration completed determination flag; explained later) is 0. Since the initial value of a bit of this flag is 0, the result in S18 in the first program loop is generally affirmative and the program proceeds to S20, in which it is determined whether a bit of an amplification determination flag of the torque converter 44 (torque converter amplification determination flag) is 0.

As explained below, a bit of the amplification determination flag is set to 1 when a condition where the output torque of the engine 30 is amplified through the torque converter 44 and transmitted to the drive shaft 42 (i.e., where the operation of the outboard motor 10 is in a range (torque amplification range) that the torque is to be amplified by the torque converter 44 to accelerate the boat 12) is established, and reset to 0 when the output torque of the engine 30 is not amplified (i.e., the operation of the outboard motor 10 is out of the torque amplification range).

Since the initial value of a bit of the amplification determination flag is also 0, the result in S20 in the first program loop is generally affirmative and the program proceeds to S22, in which it is determined whether the throttle valve 38 is operated in the opening direction, i.e., the boat 12 is in a condition to be accelerated (hereinafter called "accelerating condition"). Specifically, the calculated change amount DTH of the throttle opening TH is compared with a first throttle predetermined value (threshold value) DTHref1 and, when the change amount DTH is equal to or greater than the predetermined value DTHref1, the throttle valve 38 is determined to be operated in the opening direction (the boat 12 is in the accelerating condition). The first throttle predetermined value DTHref1 is set to a value (e.g., 0.5 degree) enabling to determine whether the boat 12 is in the accelerating condition.

When the result in S22 is negative, i.e., when the boat 12 is determined to be neither decelerated nor accelerated but is operated to cruise at a constant speed, the remaining steps are skipped and when the result is affirmative, the program proceeds to S24, in which the torque converter 44 is controlled with a lockup-OFF mode. The operation in the lockup-OFF mode is to demagnetize the lockup control valve 70 and make the lockup clutch 44*d* of the torque converter 44 OFF. As a result, the output torque of the engine 30 is amplified through the torque converter 44 and transmitted to the drive shaft 42, thereby improving acceleration performance.

Next, in S26, a bit of the torque converter amplification determination flag is set to 1 and the present program loop is terminated. When the bit of this flag is set to 1, since it means that the outboard motor 10 is in a condition that the output torque of the engine 30 is amplified by the torque converter 44 to accelerate the boat 12, the result in S20 in the next and subsequent loops is negative and the program proceeds to S28.

In S28, an input rotation speed NIN and output rotation speed NOUT of the torque converter 44 are detected or calculated. Since the input side of the torque converter 44 is connected to the crankshaft 52 of the engine 30, the input rotation speed NIN is identical with the engine speed and therefore can be detected by counting the output pulses of the crank angle sensor 84. The output rotation speed NOUT is detected from the output of the drive shaft rotation speed sensor 86.

The program proceeds to S30, in which a speed ratio e of the torque converter 44 is calculated based on the input rotation speed NIN and output rotation speed NOUT. The speed ratio e is obtained by dividing the output rotation speed NOUT by the input rotation speed NIN as shown in the following equation.

$$\text{Speed ratio } e = (\text{Output rotation speed NOUT})/(\text{Input rotation speed NIN})$$

The program proceeds to S32, in which it is determined whether the torque amplification range of the torque converter 44 has ended, precisely, whether the torque amplification range (acceleration range) has been saturated and the acceleration has been completed. Specifically, the calculated speed ratio e is compared with a reference value (threshold value) eref and when the speed ratio e is equal to or greater than the reference value eref, it is determined that the torque amplification range has ended. The reference value eref is set to a value (e.g., 0.7) enabling to determine whether the torque amplification range has ended.

When the result in S32 is affirmative, the program proceeds to S34, in which a change amount DNIN of the input rotation speed NIN (i.e., a change amount (variation) of the engine speed) is calculated. The change amount DNIN is obtained by subtracting the input rotation speed NIN detected in the present program loop from that detected in the previous program loop.

The program proceeds to S36, in which it is determined whether the speed of the boat 12 remains stable at the maximum speed or thereabout after the acceleration is completed. This determination is made by comparing an absolute value of the calculated change amount DNIN with a prescribed value (threshold value) DNINref. When the absolute value is equal to or less than the prescribed value DNINref, it is determined that the boat speed is stable at the maximum value or thereabout. The prescribed value DNINref is set to a value (e.g., 500 rpm) enabling to determine whether the speed of the boat 12 remains stable at about the maximum value after the acceleration is completed, in other words, the change amount DNIN is relatively small.

When the result in S36 is affirmative, the program proceeds to S38, in which the torque converter 44 is controlled with the lockup-ON mode. The operation of the lockup-ON mode is to magnetize the lockup control valve 70 and make the lockup clutch 44*d* ON. Since this establishes the direct connection between the crankshaft 52 of the engine 30 and the drive shaft 42, slippage of the torque converter 44 can be prevented so that the speed of the boat 12 reaches the maximum speed (in a range of the engine performance), thereby improving speed performance.

Thus, when the speed ratio e is equal to or greater than the reference value eref and the absolute value of the change amount DNIN is equal to or less than the prescribed value DNINref, the lockup clutch 44*d* of the torque converter 44 is made ON. After the step of S38, in S40, a bit of the torque converter amplification determination flag is reset to 0 and in S42, a bit of the torque converter acceleration completed determination flag is set to 1. As is clear from above, the acceleration completed determination flag is set to 1 when the acceleration through torque amplification by the torque converter 44 is completed and the lockup clutch 44*d* is made ON, and in the other cases, reset to 0, as described later.

When the result in S32 or S36 is negative, since it means that the torque amplification range of the torque converter 44 does not end (or is not saturated), or that the speed of the boat 12 is not stable at the maximum speed or thereabout, the steps of S38 to S42 are skipped and the program is terminated.

When a bit of the acceleration completed determination flag is set to 1 in S42, the result in S18 in the next and subsequent loops is negative and the program proceeds to S44 onward. In S44, based on the output of the absolute pressure sensor 76, the manifold absolute pressure Pb of the intake pipe 34 is detected or calculated and in S46, based on the detected manifold absolute pressure Pb and the change amount DTH of the throttle opening TH, it is determined whether load of the engine 30 has changed.

To be specific, in the case where, for example, the boat 12 climbs up and goes over a relatively big wave with the lockup clutch 44*d* positioned ON, the wave influences the resistance of water flow acting on the boat 12 to increase. It results in the decrease of the engine speed and the insufficiency (decrease) of the output torque of the engine 30, whereby the boat speed may decrease, as mentioned above. It is disadvantageous that the maximum speed can not be maintained.

Therefore, in this embodiment, the insufficiency of the output torque of the engine 30 due to the influence of a wave is detected or estimated based on change of load of the engine 30. When the output torque insufficiency is detected, the lockup clutch 44*d* is made OFF to amplify the output torque through the torque converter 44 so as to compensate for the insufficiency.

Specifically, in S46, when the change amount DTH is less than a second throttle predetermined value DTHref2 (e.g., 0.5 degree) and the manifold absolute pressure Pb is decreased by a first predetermined value Pbref1 or more within a predetermined time period (e.g., 500 milliseconds), i.e., when a change amount (variation) of the manifold absolute pressure Pb per a unit time is equal to or greater than the first predetermined value Pbref1 on the negative side, it is determined that the engine load has changed in the increasing direction due to the influence of a wave and the output torque is insufficient.

More specifically, when the manifold absolute pressure Pb is decreased by the first predetermined value Pbref1 or more despite the fact that the throttle opening TH hardly changes, it is estimated that the engine load has changed due to the influence of a wave. The second throttle predetermined value DTHref2 is set to a value enabling to determine whether the change of the throttle opening TH is relatively small and the first predetermined value Pbref1 is set to a value (e.g., 10 kPa) enabling to determine whether the engine load has changed due to the influence of a wave.

When it is determined in S46 that there is no change or small change in the engine load, the remaining steps are skipped and when the load is determined to have changed in the increasing direction, the program proceeds to S48, in which the torque converter 44 is controlled with the lockup-OFF mode to make the lockup clutch 44*d* OFF. As a result, the insufficiency of the output torque due to the influence of a wave is compensated through amplification. With this, it becomes possible to prevent the boat speed from decreasing, thereby maintaining the maximum speed.

The program proceeds to S50, in which a bit of the torque converter amplification determination flag is set to 1 and the program is terminated.

When the program proceeds to S46 after the lockup clutch 44*d* is made OFF in S48 in a previous program loop, the determination as to the change in the load of the engine 30 is made again. The explanation thereon will be made in detail. After the boat 12 has gone over a big wave, the increased resistance of water flow acting on the boat 12 decreases and it results in the increase of the engine speed. Since the insufficient condition of the output torque of the engine 30 ends accordingly, it is not necessary to amplify the output torque by the torque converter 44*d*. Further, at this time, if the lockup clutch 44*d* remains OFF, it causes slippage of the torque converter 44 and the maximum speed may not be maintained.

Therefore, in this embodiment, the end of the insufficient condition of the output torque of the engine 30 is detected or estimated based on the change in the engine load and when it is detected that the insufficient condition has ended, the lockup clutch 44*d* is made ON again to prevent slippage of the torque converter 44, thereby reliably maintaining the maximum speed of the boat 12.

Specifically, in S46, when the change amount DTH of the throttle opening TH is less than the second throttle predetermined value DTHref2 and the manifold absolute pressure Pb is increased by a second predetermined value Pbref2 or more within a predetermined time period (e.g., 500 milliseconds), i.e., when the change amount (variation) of the manifold absolute pressure Pb per a unit time is equal to or greater than the second predetermined value Pbref2 on the positive side, it is determined that the engine load has changed in the decreasing direction because the boat 12 has gone over a wave and the insufficient condition of the output torque of the engine 30 has ended.

More specifically, when the manifold absolute pressure Pb is increased by the second predetermined value Pbref2 or more despite the fact that the throttle opening TH hardly changes, it is estimated that the engine load has changed because there is no longer any influence of a wave. The second predetermined value Pbref2 is set to a value (e.g., 10 kPa) enabling to determine whether the engine load has changed because there is no longer any influence of a wave.

When, in S46, the engine load is determined to have changed in the decreasing direction, the program proceeds to S52, in which the torque converter 44 is controlled with the lockup-ON mode to make the lockup clutch 44*d* ON again. Owing to this configuration, slippage of the torque converter 44 after the boat 12 has gone over a wave can be prevented, thereby reliably maintaining the maximum speed. After the processing of S52, in S54, a bit of the torque converter amplification determination flag is reset to 0 and the program is terminated.

When the result in S10 is affirmative, i.e., when the shift position is neutral, the program proceeds to S56, in which the torque converter 44 is controlled with the lockup-ON mode, to S58, in which a bit of the torque converter amplification determination flag is reset to 0 and then to S60, in which a bit of the torque converter acceleration completed determination flag is reset to 0.

When the result in S16 is affirmative, i.e., when the boat 12 is in the decelerating condition, the program proceeds to S62, in which the torque converter 44 is controlled with the lockup-OFF mode, to S64, in which a bit of the amplification determination flag is set to 1, to S66, in which a bit of the acceleration completed determination flag is reset to 0 and then the program is terminated.

As stated above, the embodiment is configured to have an apparatus for and a method of controlling operation of an outboard motor (10) mounted on a stern of a boat (12) and having an internal combustion engine (30) to power a propeller (60), a drive shaft (42) connecting the engine and the propeller, and a torque converter (44) equipped with a lockup clutch (44*d*) and interposed between the engine and the drive shaft, comprising: a speed ratio calculator (ECU 90, S28, S30) that calculates a speed ratio (e) of the torque converter based on an input rotation speed (NIN) and output rotation speed (NOUT) of the torque converter; a manifold absolute pressure detector (absolute pressure sensor 76, ECU 90, S44) that detects manifold absolute pressure (Pb) of the engine; and a clutch controller (ECU 90, S32, S38, S46, S48) that controls the lockup clutch to ON when the calculated speed ratio has been equal to or greater than a reference value (eref), and controls the lockup clutch to OFF when the detected manifold absolute pressure has been decreased by a first predetermined value (Pbref1) or more.

Thus, when the manifold absolute pressure Pb is decreased by the first predetermined value Pbref1 or more, it is determined that, since the boat 12 is climbing up and going over a relatively big wave, the resistance of water flow acting on the boat 12 increases due to the influence of the wave, resulting in the insufficiency of the output torque of the engine 30, and based on the determination, the lockup clutch 44*d* is made OFF (i.e., the output torque of the engine 30 is amplified through the torque converter 44). With this, even when the resistance of water flow acting on the boat 12 increases due to the influence of a wave, the insufficiency of the output torque is compensated through amplification by the torque converter 44 and it makes possible to prevent the boat speed from decreasing, thereby maintaining the maximum speed.

Further, since the lockup clutch 44*d* is made ON when the calculated speed ratio e has been equal to or greater than the reference value eref, it becomes possible to accurately detect a time point when the acceleration is completed, and since the lockup clutch 44*d* is made ON upon the completion of acceleration, speed performance can be enhanced. Further, slippage of the torque converter 44 can be prevented by making the lockup clutch 44*d* ON, thereby avoiding fuel efficiency from deteriorating.

In the apparatus and method, the clutch controller controls the lockup clutch to ON again when the detected manifold absolute pressure has been increased by a second predetermined value (Pbref2) or more after the lockup clutch is made OFF. In other words, when the manifold absolute pressure Pb is increased by the second predetermined value Pbref2 or more, it is determined that, since the boat 12 has gone over a wave, the increased resistance of water flow acting on the boat 12 has decreased and the insufficient condition of the output torque of the engine 30 has ended, and based on the determination, the lockup clutch 44*d* is made ON again (S46, S52). With this, it becomes possible to prevent loss in transmittance caused by slippage of the torque converter 44 after the boat 12 has gone over a wave, thereby further reliably maintaining the maximum speed.

The apparatus and method further includes a throttle opening change amount detector (throttle opening sensor 74, ECU 90, S14) that detects a change amount (DTH) of throttle opening (TH) of a throttle valve (38) of the engine, and the clutch controller controls the lockup clutch to OFF when the detected change amount of the throttle opening has been less than a throttle predetermined value (second throttle predetermined value DTHref2) and the detected manifold absolute pressure is decreased by the first predetermined value or more after the lockup clutch is made ON (S46, S52). With this, in addition to the above effects, it becomes possible to detect the insufficiency of the output torque of the engine 30 due to the influence of a wave, thereby making the lockup clutch OFF at the further appropriate timing.

The apparatus and method further includes a throttle opening change amount detector (throttle opening sensor 74, ECU 90, S14) that detects a change amount of throttle opening of a throttle valve of the engine, and the clutch controller controls the lockup clutch to ON again when the detected change amount of the throttle opening has been less than a throttle predetermined value (second throttle predetermined value DTHref2) and the detected manifold absolute pressure has been increased by the second predetermined value or more after the lockup clutch is made OFF (S46, S48). With this, in addition to the above effects, it becomes possible to accurately detect the end of the insufficient condition of the output torque of the engine 30, thereby making the lockup clutch ON at the further appropriate timing.

In the apparatus and method, the reference value (eref) is a value that enables to determine that acceleration of the boat through torque amplification by the torque converter is completed.

In the apparatus and method, the first predetermined value (Pbref1) is a value that enables to determine that load of the engine has changed due to influence of a wave.

In the apparatus and method, the second predetermined value (Pbref2) is a value that enables to determine that load of the engine has changed because there is no longer any influence of a wave.

It should be noted that, although the reference value eref, first and second predetermined values Pbref1, Pbref2, displacement of the engine 30 and other values are indicated with specific values in the foregoing, they are only examples and not limited thereto.

Japanese Patent Application No. 2009-101154 filed on Apr. 17, 2009 is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising:

a speed ratio calculator that calculates a speed ratio of the torque converter based on an input rotation speed and output rotation speed of the torque converter;

a manifold absolute pressure detector that detects manifold absolute pressure of the engine; and a clutch controller that controls the lockup clutch to ON when the calculated speed ratio has been equal to or greater than a reference value, and controls the lockup clutch to OFF when the detected manifold absolute pressure has been decreased by a first predetermined value or more.

2. The apparatus according to claim 1, wherein the clutch controller controls the lockup clutch to ON again when the detected manifold absolute pressure has been increased by a second predetermined value or more after the lockup clutch is made OFF.

3. The apparatus according to claim 1, further including:

a throttle opening change amount detector that detects a change amount of throttle opening of a throttle valve of the engine, and the clutch controller controls the lockup clutch to OFF when the detected change amount of the throttle opening has been less than a throttle predetermined value and the detected manifold absolute pressure is decreased by the first predetermined value or more after the lockup clutch is made ON.

4. The apparatus according to claim 2, further including:

a throttle opening change amount detector that detects a change amount of throttle opening of a throttle valve of the engine, and the clutch controller controls the lockup clutch to ON again when the detected change amount of the throttle opening has been less than a throttle predetermined value and the detected manifold absolute pressure has been increased by the second predetermined value or more after the lockup clutch is made OFF.

5. The apparatus according to claim 1, wherein the reference value is a value that enables to determine that acceleration of the boat through torque amplification by the torque converter is completed.

6. The apparatus according to claim 1, wherein the first predetermined value is a value that enables to determine that load of the engine has changed due to influence of a wave.

7. The apparatus according to claim 2, wherein the second predetermined value is a value that enables to determine that load of the engine has changed because there is no longer any influence of a wave.

8. A method of controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising steps of:

calculating a speed ratio of the torque converter based on an input rotation speed and output rotation speed of the torque converter;

detecting manifold absolute pressure of the engine; and controlling the lockup clutch to ON when the calculated speed ratio has been equal to or greater than a reference value, and controlling the lockup clutch to OFF when the detected manifold absolute pressure has been decreased by a first predetermined value or more.

9. The method according to claim 8, wherein the step of controlling controls the lockup clutch to ON again when the detected manifold absolute pressure has been increased by a second predetermined value or more after the lockup clutch is made OFF.

10. The method according to claim 8, further including:

detecting a change amount of throttle opening of a throttle valve of the engine, and the step of controlling controls the lockup clutch to OFF when the detected change amount of the throttle opening has been less than a throttle predetermined value and the detected manifold absolute pressure is decreased by the first predetermined value or more after the lockup clutch is made ON.

11. The apparatus according to claim 9, further including:

detecting a change amount of throttle opening of a throttle valve of the engine, and the step of controlling controls the lockup clutch to ON again when the detected change amount of the throttle opening has been less than a throttle predetermined value and the detected manifold absolute pressure has been increased by the second predetermined value or more after the lockup clutch is made OFF.

12. The method according to claim 8, wherein the reference value is a value that enables to determine that acceleration of the boat through torque amplification by the torque converter is completed.

13. The method according to claim 8, wherein the first predetermined value is a value that enables to determine that load of the engine has changed due to influence of a wave.

14. The method according to claim 9, wherein the second predetermined value is a value that enables to determine that load of the engine has changed because there is no longer any influence of a wave.

* * * * *